US011369171B2

(12) United States Patent
Tan

(10) Patent No.: US 11,369,171 B2
(45) Date of Patent: Jun. 28, 2022

(54) JOINT FINGER RING

(71) Applicant: Bowen Tan, Shanghai (CN)

(72) Inventor: Bowen Tan, Shanghai (CN)

( * ) Notice: Subject to any disclaimer, the term of this patent is extended or adjusted under 35 U.S.C. 154(b) by 13 days.

(21) Appl. No.: 17/060,200

(22) Filed: Oct. 1, 2020

(65) Prior Publication Data

US 2021/0015221 A1 Jan. 21, 2021

Related U.S. Application Data

(63) Continuation of application No. PCT/CN2018/093810, filed on Jun. 29, 2018.

(51) Int. Cl.
*A44C 9/00* (2006.01)
*A44C 9/02* (2006.01)

(52) U.S. Cl.
CPC ..... *A44C 9/0046* (2013.01); *A44C 9/02* (2013.01)

(58) Field of Classification Search
CPC . A44B 11/2592; A44B 11/266; A44C 9/0046; A44C 9/02; A44C 5/0053; A44C 5/0061; A44C 5/105; A44C 5/107; A44C 5/20; A44C 5/2009; A44C 5/2052; A44C 5/2071; A44C 9/0076; A44C 13/00; A44C 15/00; A44C 5/00
USPC ..... 63/15, 40
See application file for complete search history.

(56) References Cited

U.S. PATENT DOCUMENTS 4,158,951 A * 6/1979 Cedar ..... A44C 5/2042 63/5.1
9,809,047 B2 11/2017 Whaley et al.
2011/0266797 A1 11/2011 Stobbart
2017/0280836 A1 10/2017 Zhao

FOREIGN PATENT DOCUMENTS

CH 697560 B1 * 11/2008 ..... A44C 17/02
CN 101642314 A 2/2010
CN 201822079 U 5/2011
CN 205410010 A 8/2016
CN 205432434 U 8/2016
CN 107041609 A 8/2017
FR 568919 A 4/1924
JP S5348157 Y2 11/1978

OTHER PUBLICATIONS

Internation Search Report of PCT/CN2018/093810, dated Mar. 27, 2019.

* cited by examiner

*Primary Examiner* — Jack W Lavinder

(57) ABSTRACT

The innovative product is a joint finger ring, particularly refers to a finger ring capable of being spliced, assembled, bent and adjusted, and relates to the technical field of ornamental finger rings and watchbands. A joint finger ring is composed of a ring setting (1), inlays (2) and connection components (3), wherein the inlays (2) are arranged in the ring setting (1). The left end and the right end of the ring setting (1) are movably connected through the connection components (3). The utility model solves the problem that in the wearing process of the traditional finger ring, the size of the finger ring of a favorite style is appropriately increased to fit the finger, and consequently, it is impossible to achieve the best feeling when people wear the finger ring, and especially for the characteristics of the male finger bones, the finger ring cannot be taken off.

6 Claims, 10 Drawing Sheets

Three-dimensional diagram of assemblingmode II of the ring setting

JOINT FINGER RING

CROSS-REFERENCE TO RELATED APPLICATIONS

This application is a continuation of International Patent Application No. PCT/CN2018/093810 with a filing date of Jun. 29, 2018, designating the United States, now pending.

TECHNICAL FIELD

The innovative product relates to the technical field of ornamental finger rings and watchbands, and particularly relates to a spliceable, assemblable, bendable and adjustable joint finger ring.

BACKGROUND

At least in modern times, most of finger rings in the jewelry market have different appearances, but most of them are always fixed circular finger rings. Although the size of each finger ring is optional at the beginning of the purchase, the finger ring is inevitable to pass through finger joints during a wearing process. Therefore, the size of the finger ring may be appropriately increased at the beginning of production to fit the finger. As a result, it is impossible to achieve the best feeling when people wear the finger ring; and moreover, due to a lot of reasons, the finger ring may not be taken off, which is more obvious especially for the characteristics of male finger bones. Moreover, most of the finger rings cannot change their appearances after being bought, which is mainly reflected in the fact that when consumers want to buy products of the same style with different inlays, they must buy the same products again besides the inlays.

SUMMARY

The purpose of the innovative product is to overcome the defects and disadvantages of the prior art and provide a joint finger ring. The whole structure of the finger ring is composed of three parts: one is a ring setting, wherein the ring setting is a main integral part of this type of finger rings, and various jewelries, inlays and appearances of the ring setting can be changed through the modular disassembling and assembling of components of the ring setting. The second is, ring plane inlays, which play a role in adding a finishing touch to make the appearance beautiful. The ring plane inlays are embedded into inlay wrapping materials to form an integral module to achieve an modular disassembling and assembling effect, so that the inlays, the appearances of the inlays or the overall appearance of the finger ring can be appropriately adjusted. The third is connection components which movably connect two ends of the ring setting. Through finely-adjustable connection module, the finger ring can be comfortably worn onto the finger.

The joint finger ring is composed of a ring setting, inlays and connection components, wherein the inlays are arranged on the ring setting through inlay wrapping materials, and the left end and the right end of the ring setting are movably connected through the connection components. With a structure similar to a component structure of a watchband, various functions such as splicing, bending, disassembling, assembling and adjusting can be realized.

The ring setting is similar to a watchband, and capable of being bent, disassembled and assembled and can adjust the appearance of the ring setting. The ring setting is composed of ring setting components, novel C-shaped pins and C-shaped pipes or fixed caps and fixed pins. The structure of the ring setting can be disassembled and assembled in a modularization manner, so that the appearance adjustability of the ring setting can be realized. The ring setting is made of precious metals such as gold, platinum, silver or ordinary metals or wooden materials, ceramic materials, clay materials, jadeite, Hetian jade materials, Shoushan stone materials, marble materials or purple sands.

The inlay is a part to beautify the appearance of the ring setting. Compared with the previous process of directly embedding the inlays into the ring setting, this type of finger rings can be freely disassembled and assembled by inserting the inlays into the inlay wrapping materials in advance, thereby achieving the appropriate adjustment of the appearance of the ring setting.

Each of the connection components is composed of a module A and a module B to form functions of movable connection and fine adjustment, which incorporates the design concepts of ergonomics, overall aesthetics, ultra-thin standards, convenient use, and feasible craftsmanship.

DETAILED DESCRIPTION OF PREFERRED EMBODIMENTS

The utility model is further described below in combination with the drawings and embodiments.

Figure 1:
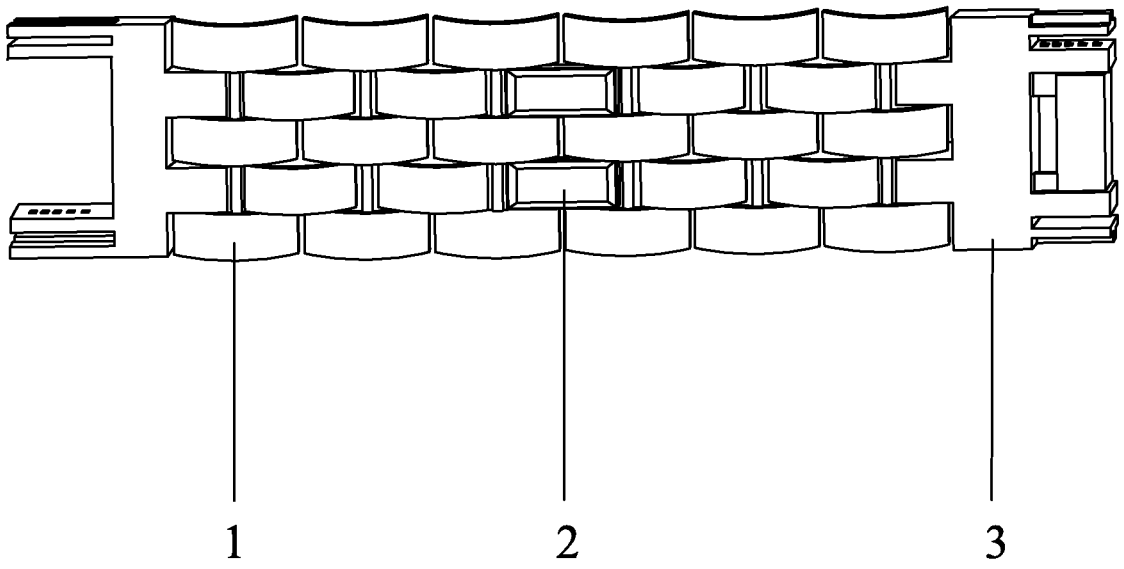
FIG. 1 is a structural schematic diagram of a joint finger ring of the utility model.
Figure 2:
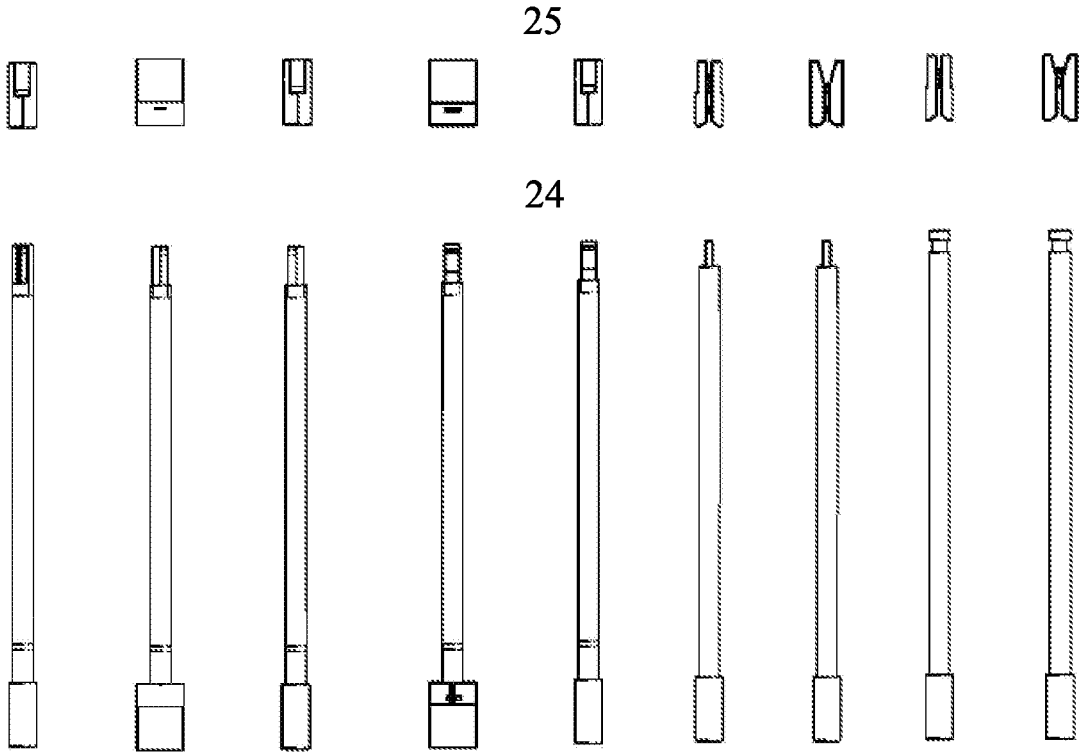
FIG. 2 is a plan of fixed caps and fixed pins of embodiments.
Figure 3:
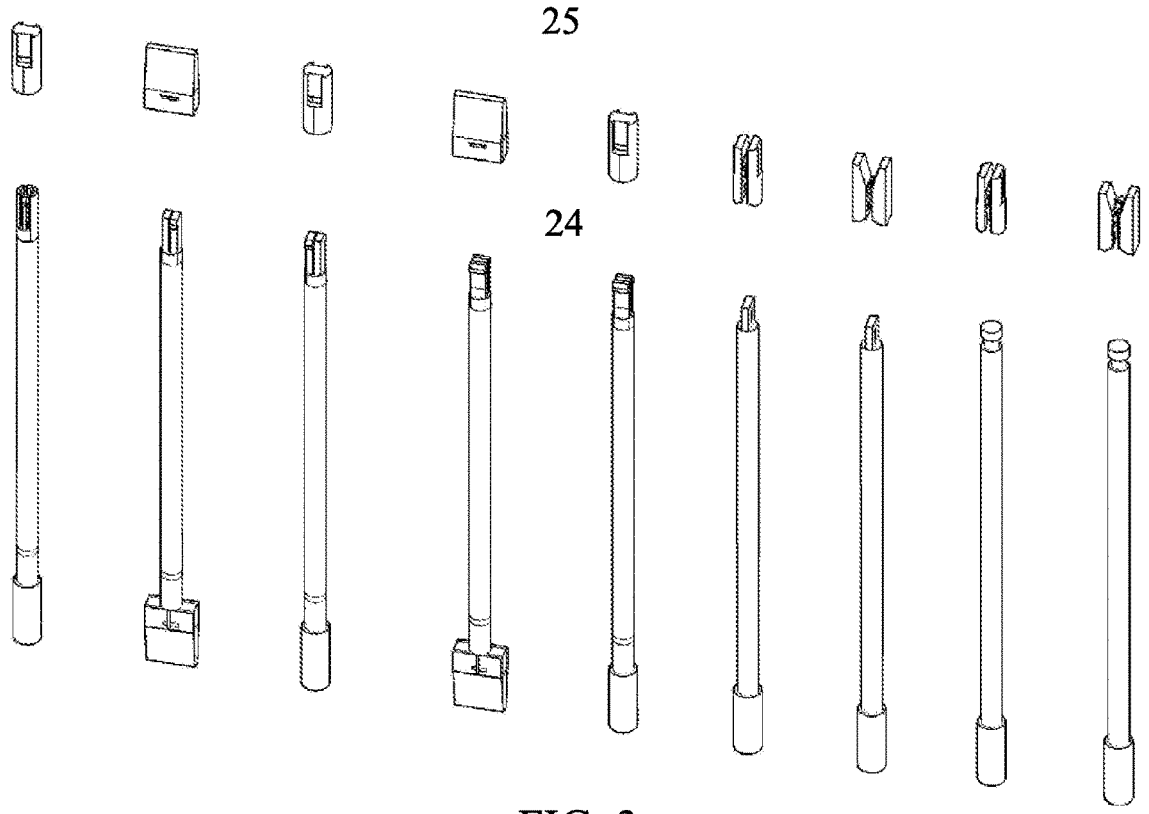
FIG. 3 is three-dimensional schematic diagram of fixed caps and fixed pins of embodiments.
Figure 4:
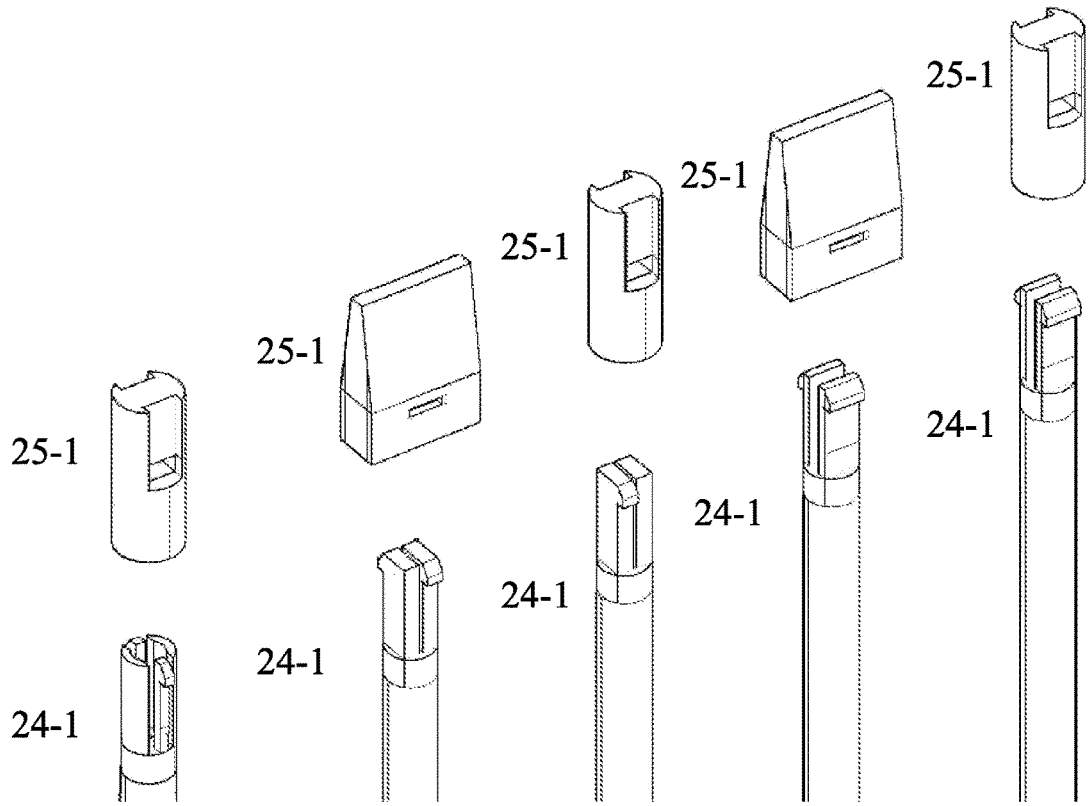
FIG. 4 is a structural three-dimensional schematic diagram of fixed the pin 24-1 and the fixed cap 25-1 of embodiments.
Figure 5:
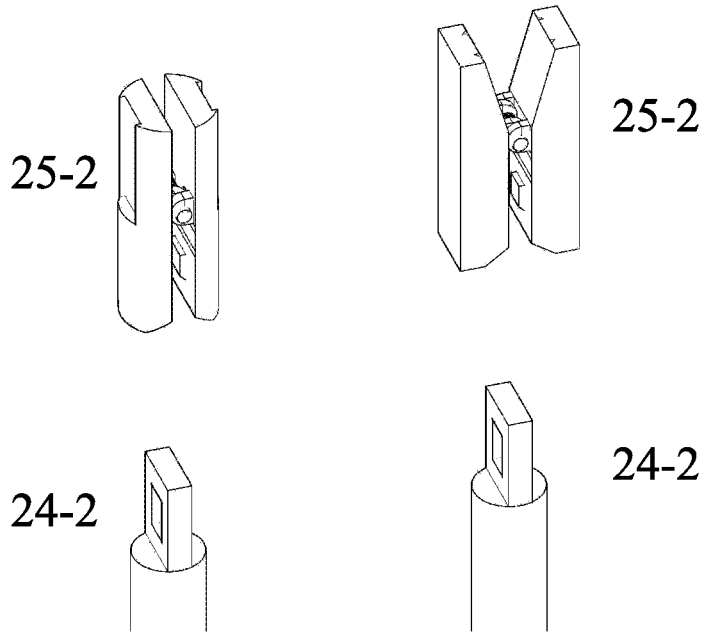
FIG. 5 is a structural three-dimensional schematic diagram of fixed the pin 24-2 and the fixed cap 25-2 of embodiments.
Figure 6:
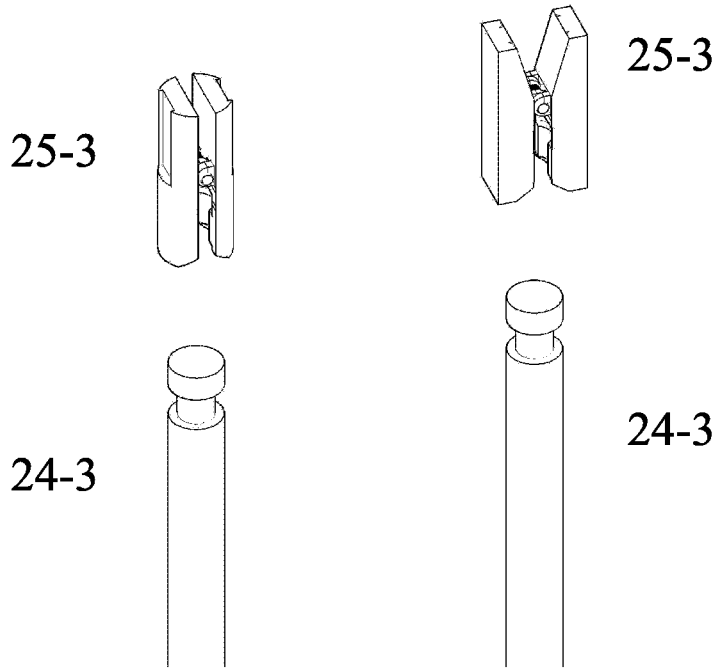
FIG. 6 is a structural three-dimensional schematic diagram of fixed the pin 24-3 and the fixed cap 25-3 of embodiments.

A joint finger ring (as shown in FIG. 1) is composed of a ring setting 1, inlays 2 and connection components 3, wherein the inlays 2 are embedded into inlay wrapping materials to form an integral module to be arranged into the ring setting 1. The left end and the right end of the ring setting 1 are movably connected through the connection components 3.

The ring setting 1 is similar to a watchband and can be bent, disassembled and assembled. The ring setting is composed of ring setting components 21, novel C-shaped pins and C-shaped pipes or fixed pins 24 and fixed caps 25.

The fixed pin 24 can be correspondingly connected with the fixed cap 25. Through the innovative design of the internal structure, the function for fixing the ring components and the function for easily adjusting the appearance (as shown in FIG. 2-FIG. 6) can be realized.

The fixed cap 25 can be correspondingly connected with the fixed pin 24. Through the innovative design of the internal structure, the function for fixing the ring components and the function for easily adjusting the appearance (as shown in FIG. 2-FIG. 6) can be realized.

Figure 7:
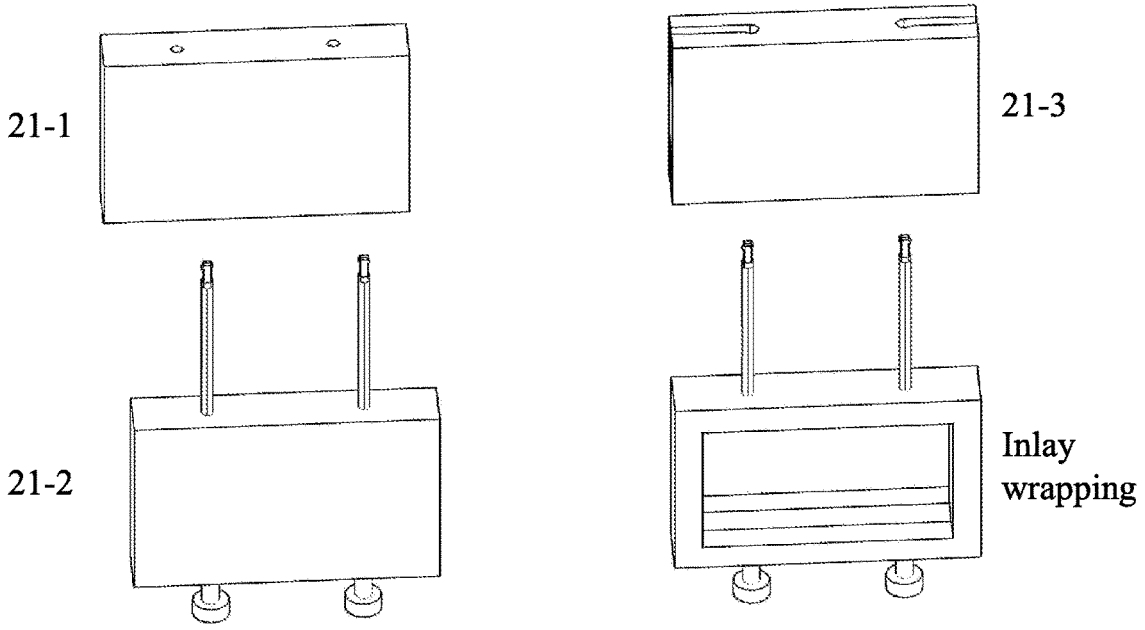
FIG. 7 is a structural three-dimensional schematic diagram of a ring setting component 21 and an inlay wrapping material of embodiments.
Figure 8:
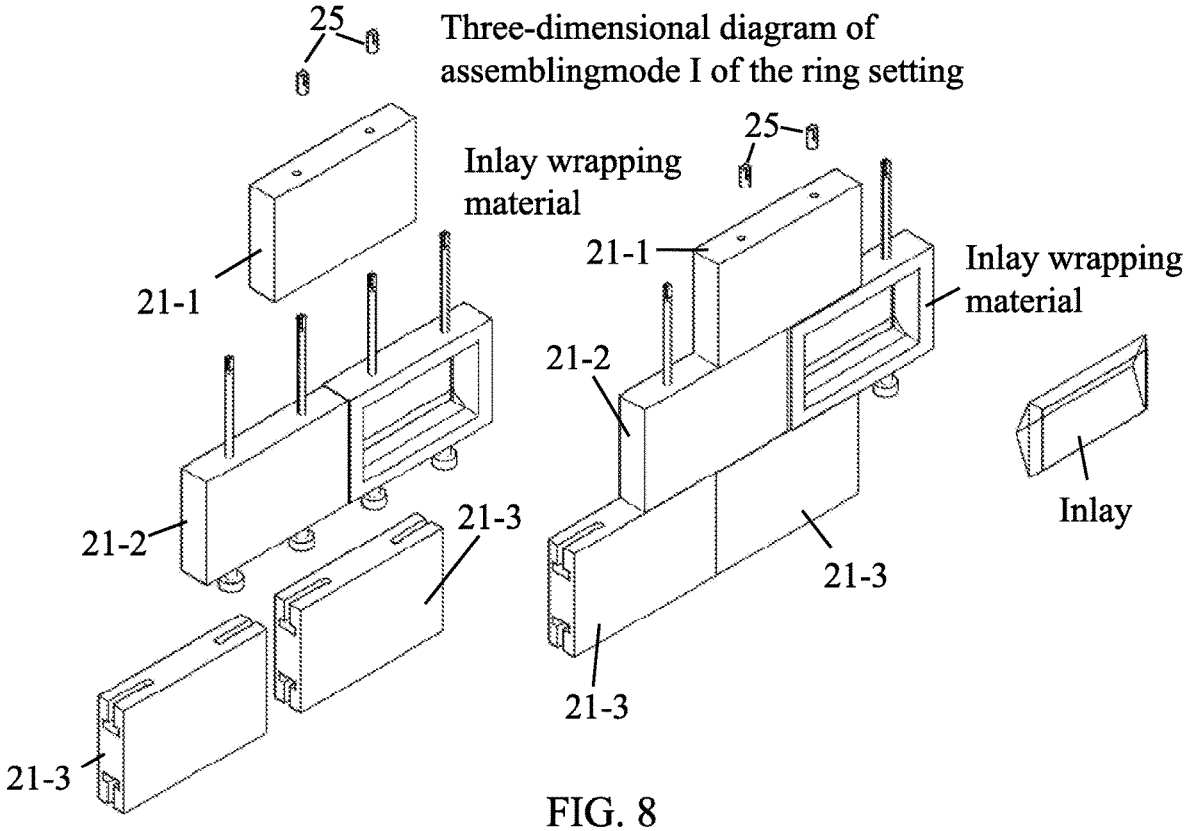
FIG. 8 is a three-dimensional schematic diagram of an assembling mode I of a ring setting of embodiments.
Figure 9:
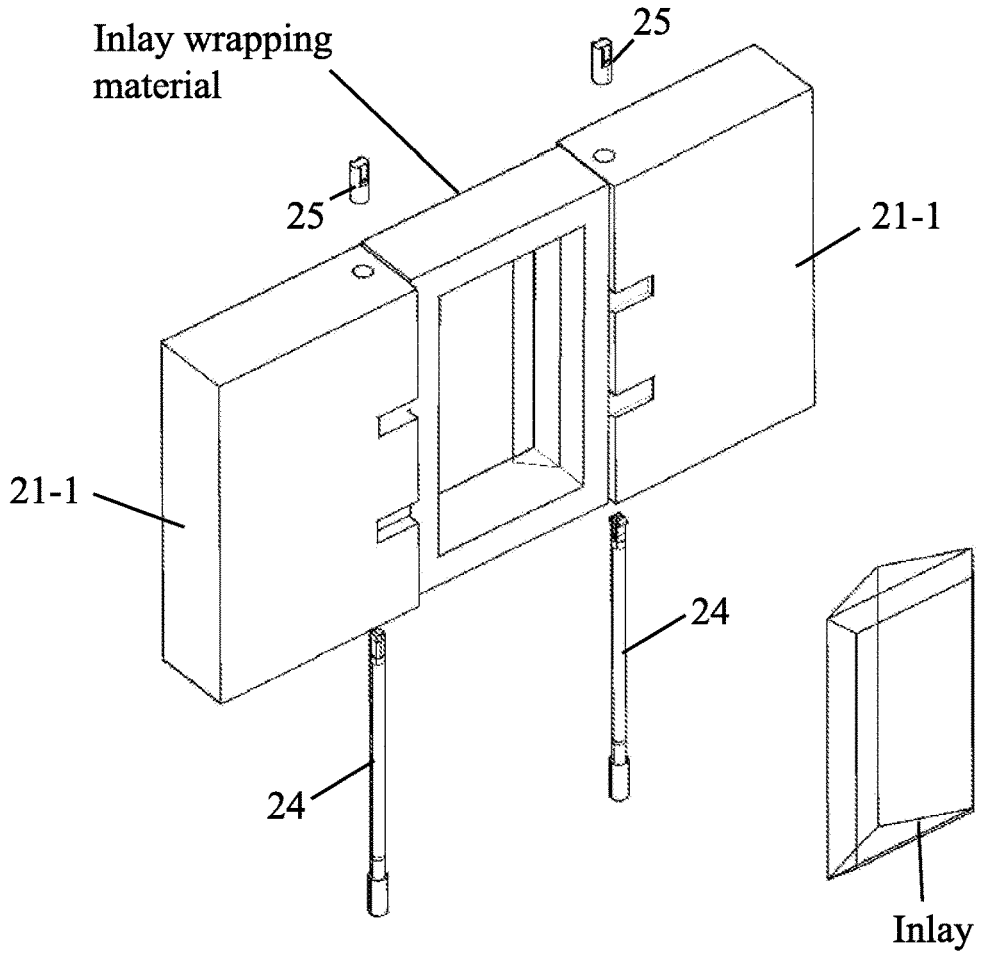
FIG. 9 is a three-dimensional schematic diagram of an assembling mode II of the ring setting of embodiments.

The ring setting components 21 are modular components that can be disassembled and assembled into the appearance of the ring setting 1 (as shown in FIG. 7-FIG. 9).

Figure 10:
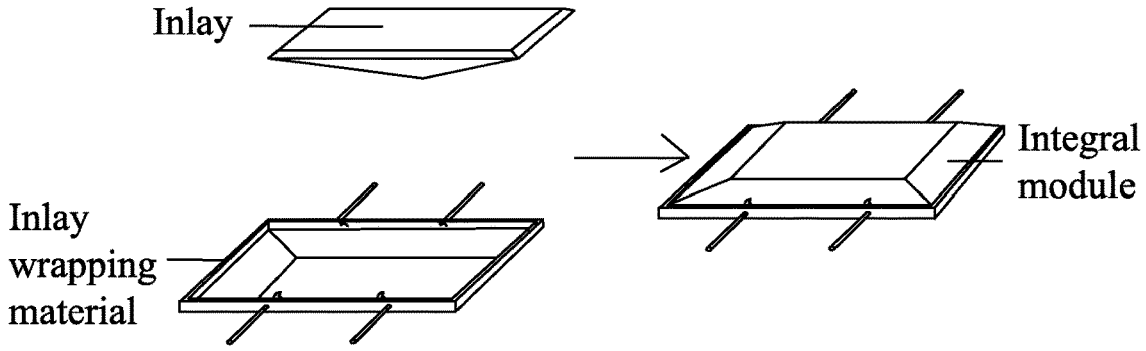
FIG. 10 is a schematic diagram showing the formation of an integral module of embodiments.
Figure 11:
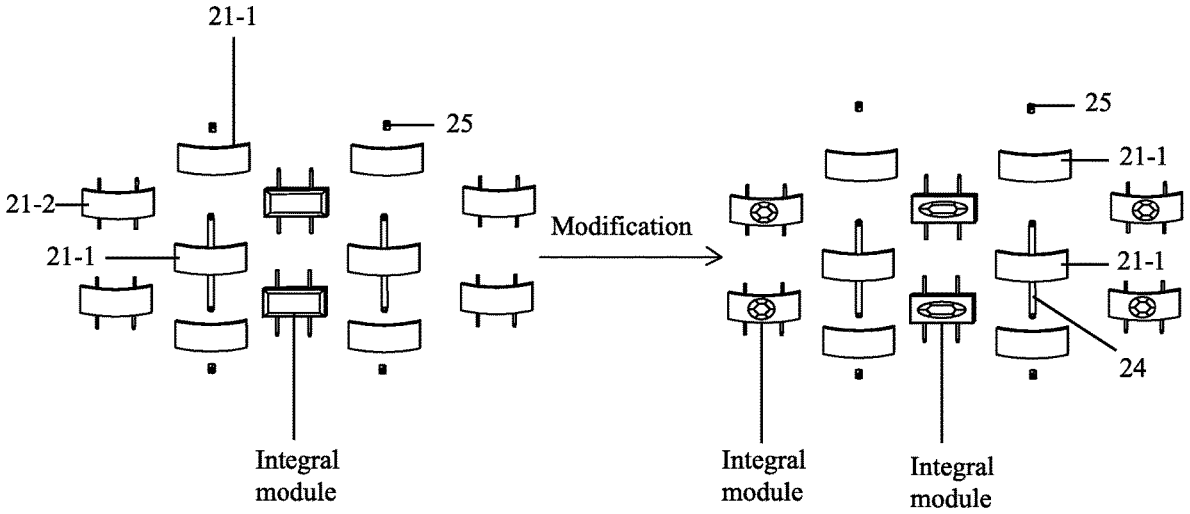
FIG. 11 is schematic diagram showing an appearance of the ring setting of embodiments.
Figure 12:
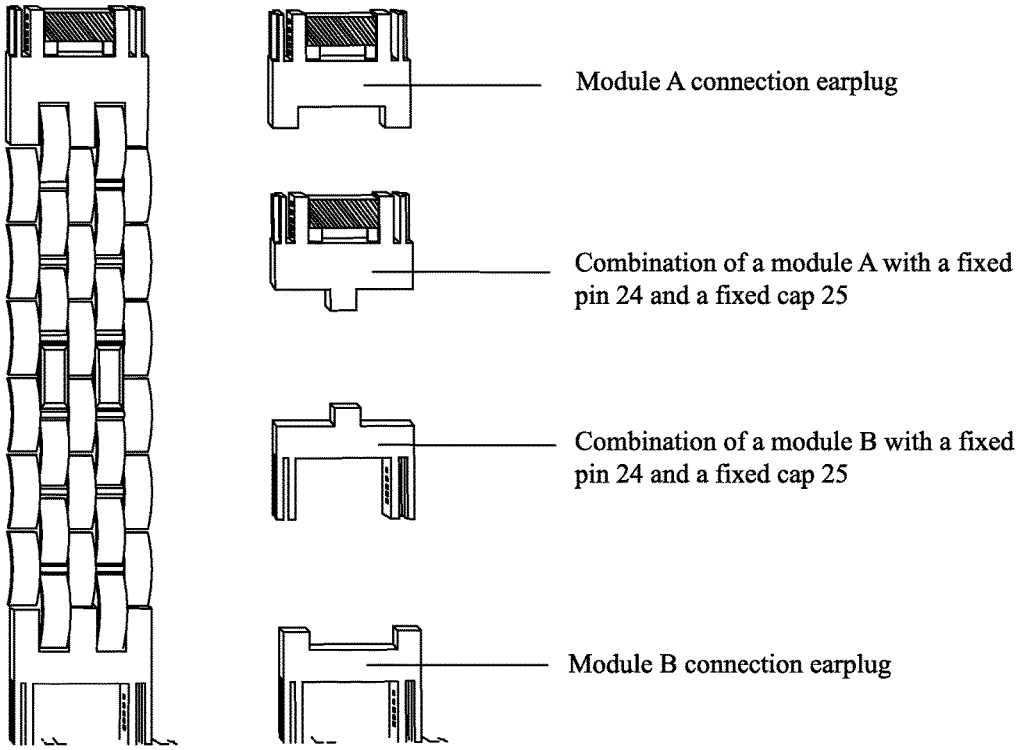
FIG. 12 is a schematic diagram showing a junction position of the module A and the module B on the ring setting of the embodiments.

The inlays are embedded into the inlay wrapping materials to form the integral module to be arranged in the ring setting 1 (as shown in FIG. 8-FIG. 10).

The connection component 3 is composed of a module A and a module B to form the movable connection (as shown in FIG. 12 and FIG. 17-FIG. 19).

Figure 13:
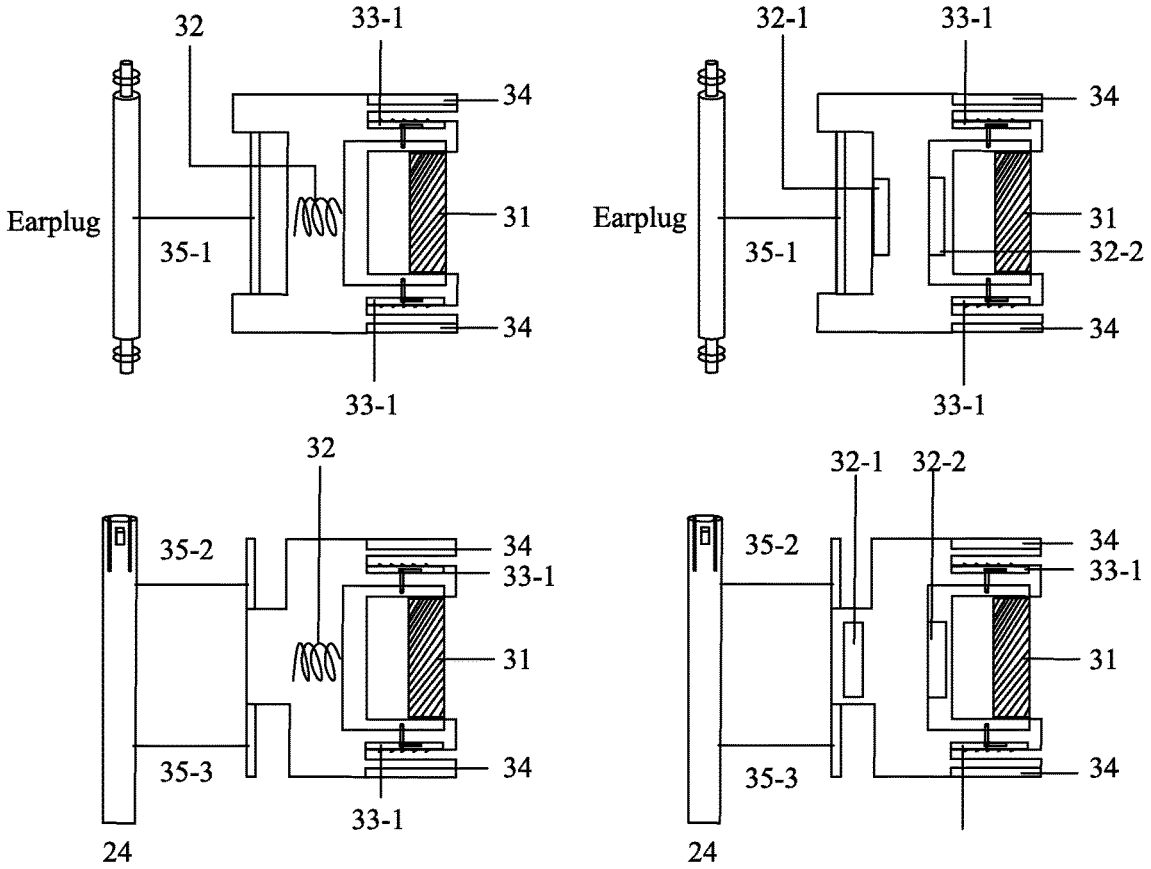
FIG. 13 is a schematic diagram of an internal structure of the module A of the embodiments.

In the joint finger ring, the module A includes a lock switch button 31, a return spring 32 or a return magnet 32-1 and a return magnet 32-2, module A joint bayonets 33-1, a fixed bulge or notch 34, a module A ring setting joint 35-1 or 35-2 and 35-3 (as shown in FIG. 13).

The return spring 32 or the return magnet 32-1 and the return magnet 32-2 are located right below the tail of the module A lock switch button 31 (as shown in FIG. 13).

The module A joint bayonets 33-1 are located at two sides of the lock switch button 31. The module A joint bayonet 33-1 is composed of a toothed opening, a toothed opening spring or a toothed opening return magnet 1, a toothed opening carrier rod and a movable knuckle (as shown in FIG. 13).

The toothed opening is located in the toothed opening carrier rod and is a row of triangular movable exposed bayonets.

Figure 14:
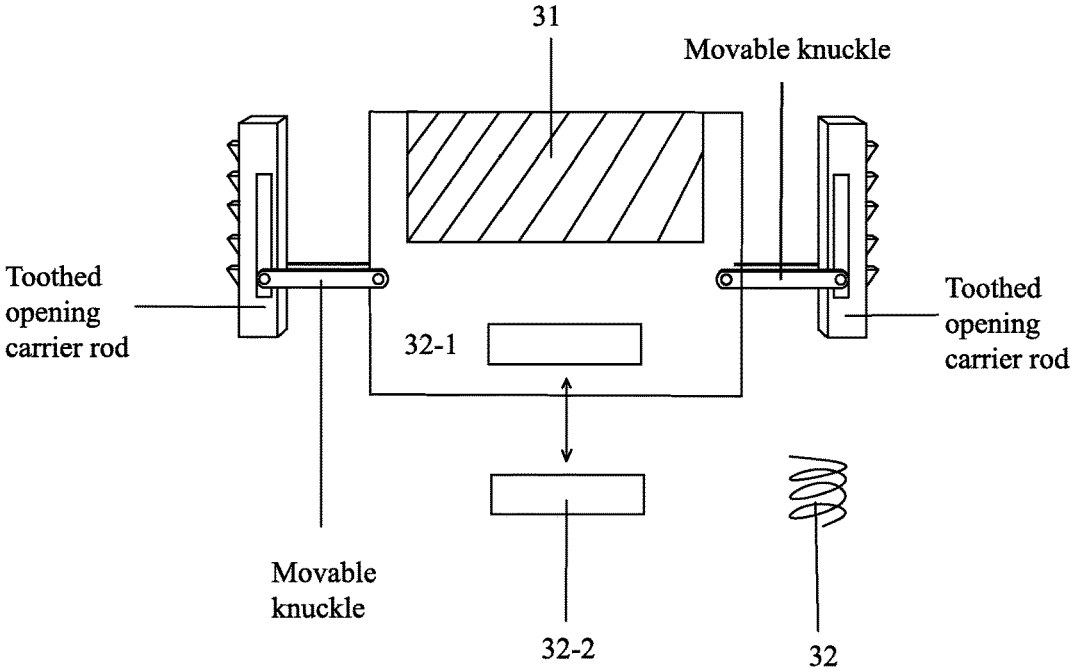
FIG. 14 is a schematic diagram of internal components of the module A of the embodiments.
Figure 15:
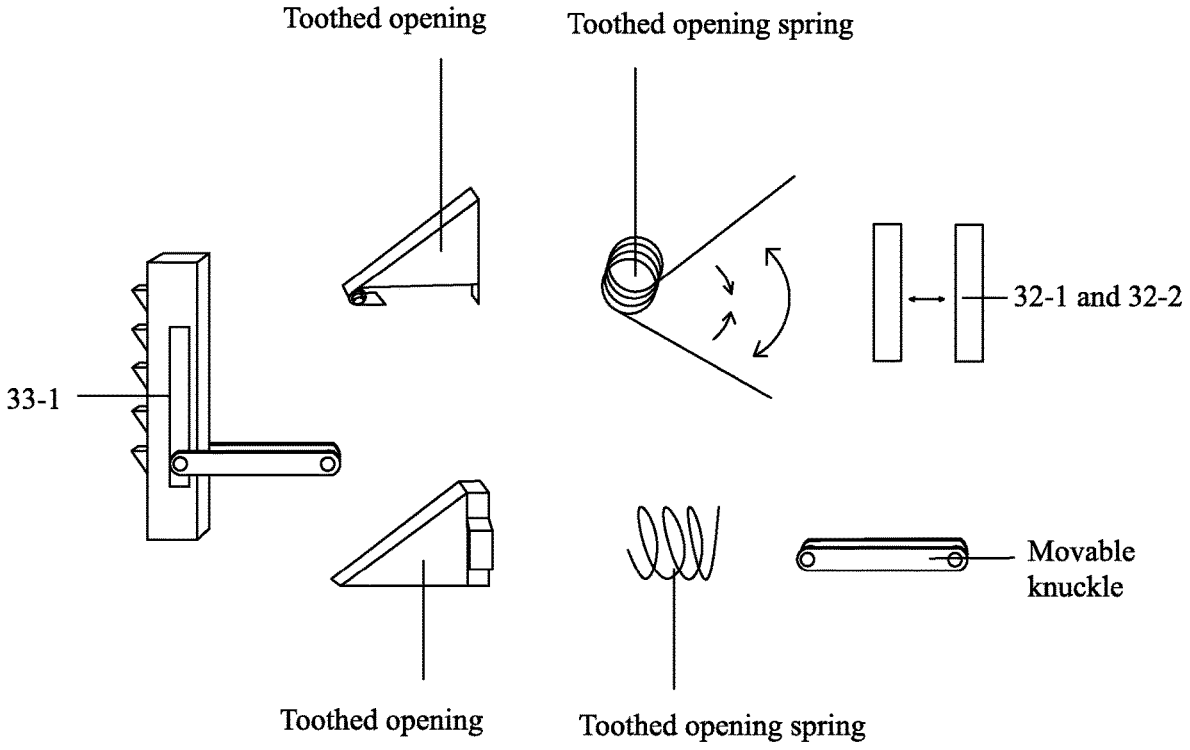
FIG. 15 is a schematic diagram of internal components of a carrier rod of the embodiments.
Figure 16:
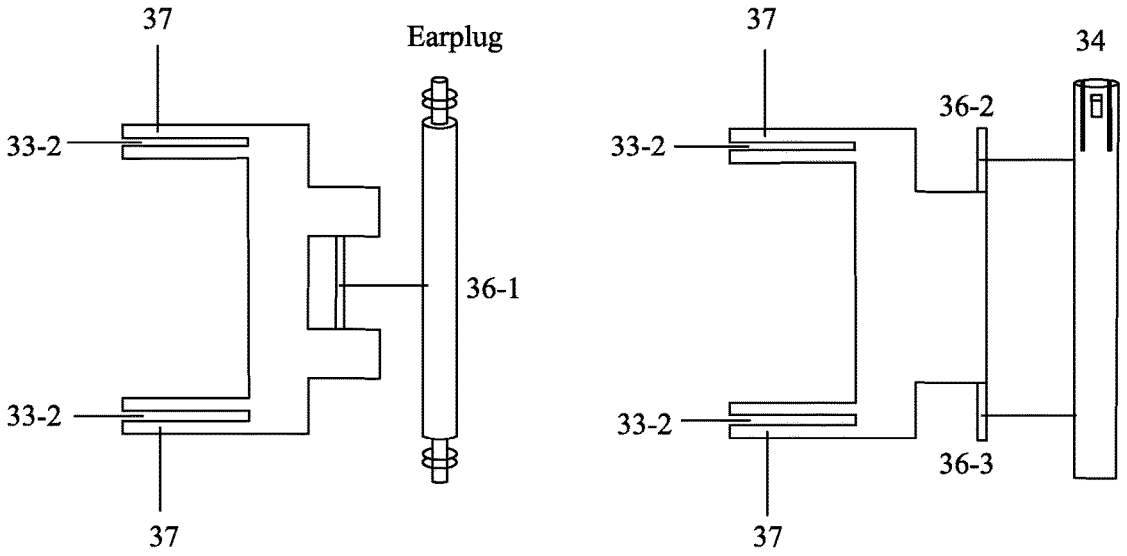
FIG. 16 is a structural schematic diagram of the module B of the embodiments.

The toothed opening carrier rod is connected with the lock switch button 31 through the movable knuckle. The movable knuckle is perpendicular to a position between the toothed opening carrier rod and the lock switch button 31 (as shown in FIG. 14-FIG. 15).

The fixed bulge or notch 34 is located on the left end and the right end of the module A and is used for the up-down fixation of the module A and the module B at a connection state correspondingly together with the fixed notch or bulge 37 in the module B.

The module A passes through the ring setting joint 35-1 to be connected with one end of the ring setting through an earplug or the module A is connected with one end of the ring setting through the connection of the ring setting joint 35-2 and the ring setting joint 35-3 and the fixed pin 24 and the fixed cap 25 (as shown in FIG. 13).

Figure 17:
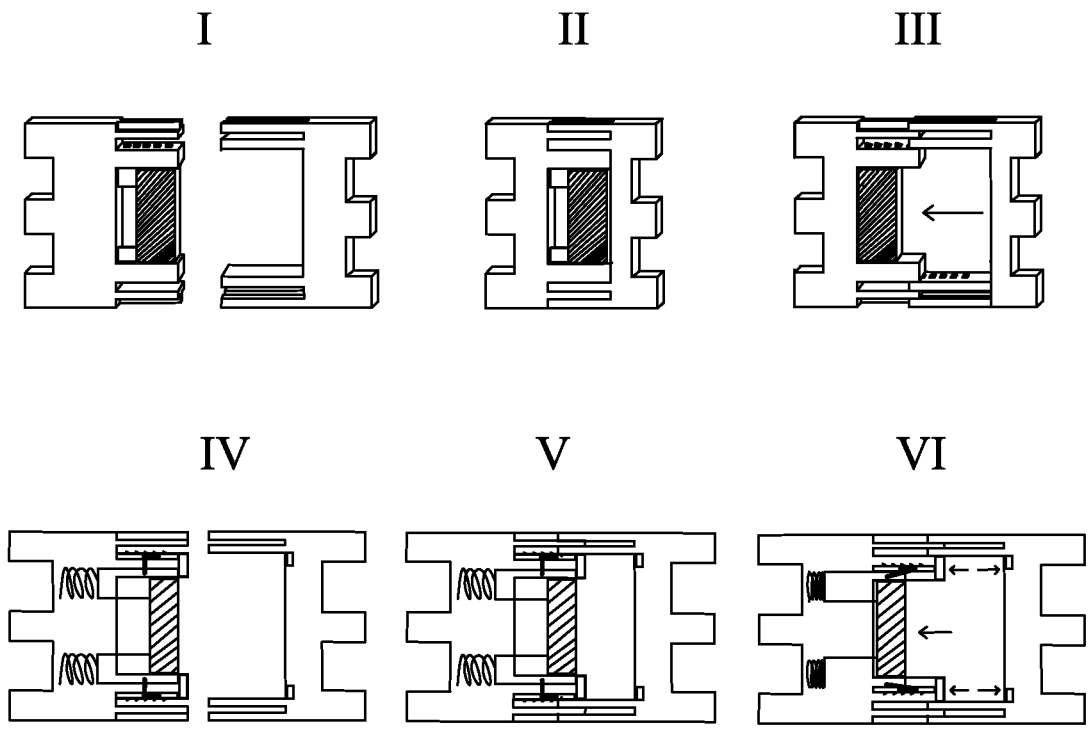
FIG. 17 is a structural schematic diagram showing the connection and disconnection between the module A and the module B of the embodiments.
Figure 18:
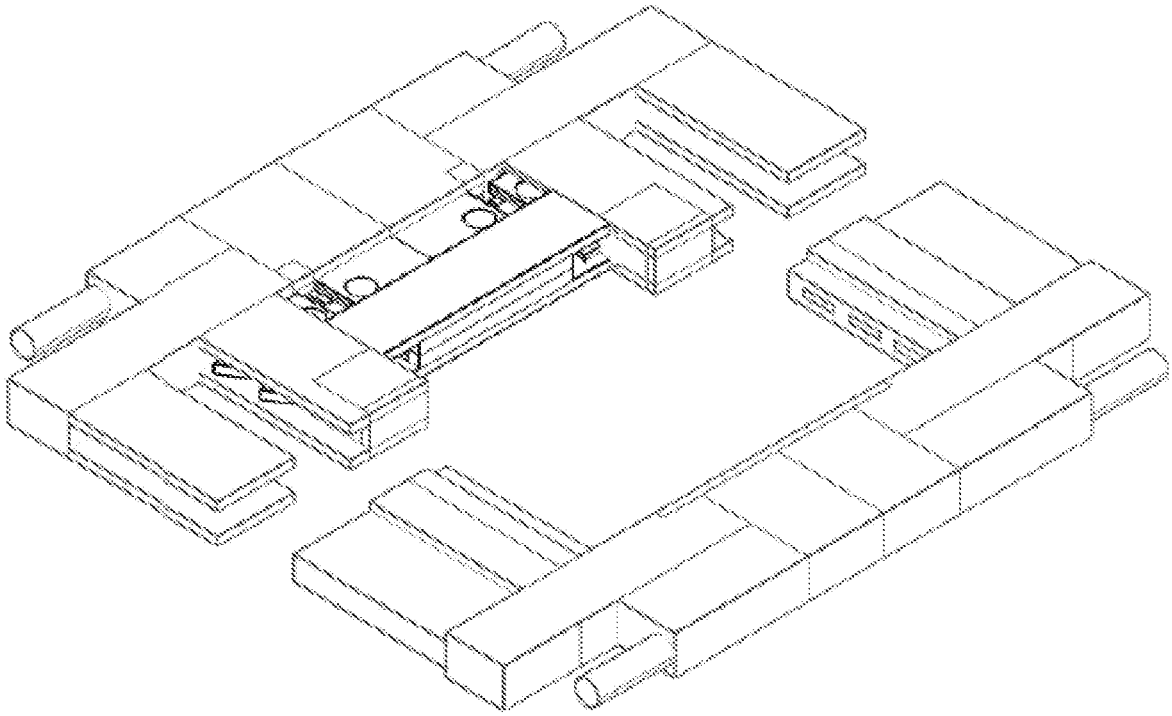
FIG. 18 is a front view of the appearance of the module A of the embodiments.
Figure 19:
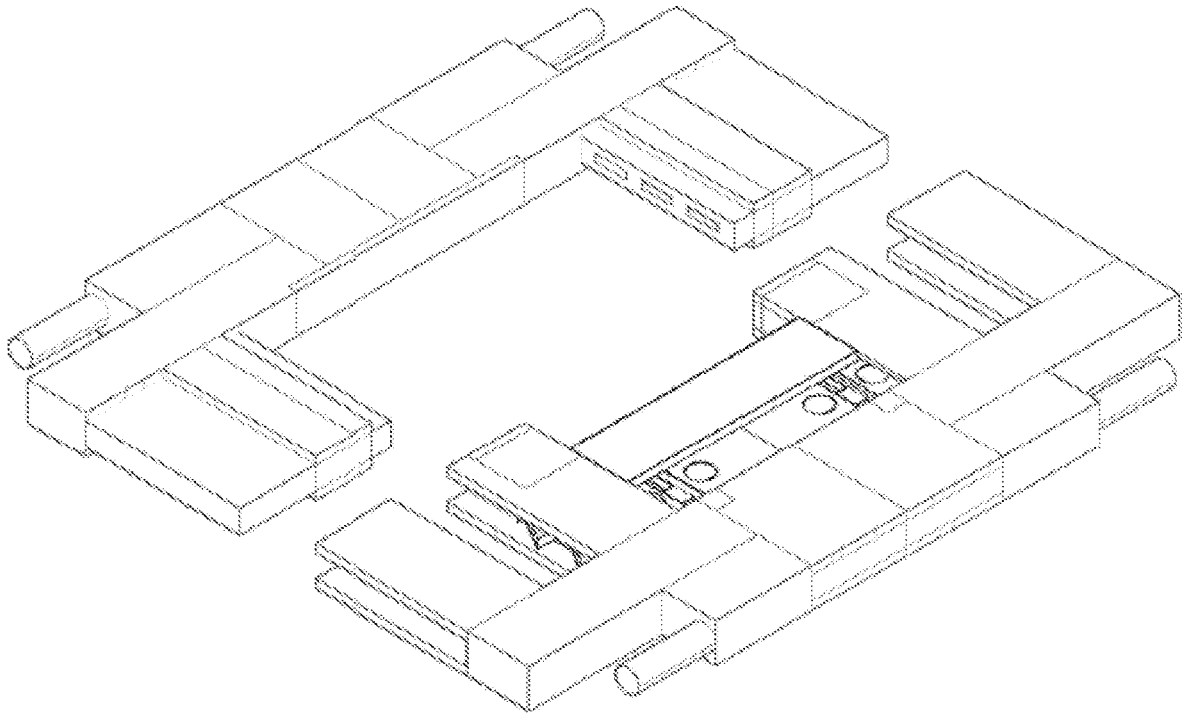
FIG. 19 is a front view of the appearance of the module B of the embodiments.

Functions of Components:

When the module A and the module B are correspondingly connected by a user, under the interaction of three components, i.e. the toothed opening, the toothed opening spring and the module B joint bayonets 33-2, the finger ring can be worn on the finger; and when the module A and the module B are separated by the user, the lock switch button 31 is pressed down; after the toothed opening carrier rod is pulled towards the inner side through the movable knuckle, the toothed opening is separated from a slot in the module B joint bayonets 33-2, thereby separating the module A and the module B (as shown in FIG. 17).

Before the wearing (referring to I and IV in FIG. 17): the components in the module A and the module B are on fixed positions.

During the wearing (referring to II and V in FIG. 17): the first joint bayonet 33-1 on the front end of the module A is connected with a connection position of the second joint bayonet 33-2 on the front end of the module B.

In this process, the exposed toothed opening of the module A may be continuously pushed by the module A joint bayonets 33-2 to have a telescopic motion so as to be fixed in the longitudinal direction. At the same time, the fixed bulge or notch 34 in the module A is correspondingly connected with the fixed notch or bulge 37 in the module B so as to fix the module A in the vertical direction and to adjust the feeling to the best state.

The toothed opening is under the action of the toothed opening spring or the toothed opening return magnet 1. Through the toothed opening spring or the toothed opening return magnet 1, the triangular slot on the connection position of the joint bayonets 33-2 in the module B can be correspondingly connected with the toothed opening along with the connection action.

After the wearing (referring to II in FIG. 17): the module A and the module B are correspondingly connected in the vertical and longitudinal directions, and each component in the module A is returned.

During the separation (referring to III and VI in FIG. 17): the lock switch button 31 is pushed backwards first, and at this moment, the exposed toothed opening may be retracted inwards, so that the module A and the module B have no fixed connection in the longitudinal direction.

After the separation: each component in the module A is returned.

In conclusion, this innovative design solves the problem that in the wearing process of the traditional finger rings, the size of the finger ring of the favorite style is appropriately increased at the beginning of selection or customization so as to fit the finger. As a result, it is impossible to achieve the best feeling when people wear the finger ring; and moreover, due to a lot of reasons, the finger ring may not be taken off, which is more obvious especially for the characteristics of male finger bones. Meanwhile, when the consumer needs the product of the same style with different appearances, only the corresponding accessories need to be added, so that the trouble for purchasing the whole product with the original structure can be avoided. Based on the market demand, this design incorporates the design concepts of ergonomics, overall aesthetics, ultra-thin standards, convenient use and feasible craftsmanship. The innovative design is made on the basis of the traditional concept of the existing finger ring, thereby providing technical and material basis to fill a gap in the market.

I claim:

1. A kit for forming a joint finger ring, comprising a ring setting (1), inlays (2) and connection components (3), wherein the inlays (2) are embedded into inlay wrapping materials to form an integral module to be arranged in the ring setting (1), and the left end and the right end of the ring setting (1) are movably connected through the connection components (3);

the ring setting (1) is composed of ring setting components (21), fixed pins (24) and fixed caps (25) that form a flexible band between the connection component, wherein the ring setting components (21) are made of precious metals such as gold, platinum, silver or ordinary metals or wooden materials, ceramic materials, clay materials, jadeite, Hetian jade materials, Shoushan stones, marble materials or purple sands and is structurally composed of a first ring setting component (21-1), a second ring setting component (21-2) and a third ring setting component (21-3), wherein the first ring setting component (21-1) is entirely perforated from top to bottom and correspondingly connected with the fixed pins and fixed caps;

the second ring setting component (21-2) is combined with the fixed pins and has T-shaped chucks;

the third setting component (21-3) is internally provided with T-shaped rails, which are correspondingly connected with the T-shaped chucks in the ring setting component (21-2).

2. The kit according to claim 1, wherein for the fixed pins (24), a head of each of the fixed pin (24-1) has two outwardly-bulged fixed pins bayonets which are correspondingly inserted into slots of each of the fixed caps (25-1) through an elasticity of a metal; or the head of each of the fixed pins (24-2) has a hollow slot fitting each of the fixed caps (25-2); or the head of each of the fixed pins (24-3) is a cylindrical bayonet correspondingly inserted into a concave annular slot of each of the fixed caps (25-3).

3. The kit according to claim 2, wherein a module A comprises a lock switch button (31), a return spring (32), module A joint bayonets (33-1), a fixed bulge or notch (34), a module A ring setting joint (35-1) or a module A ring setting joint (35-2) and a module A ring setting joint (35-3);

wherein the lock switch button (31) used for movably separating the module A and a module B is located on the middle position of the module A;

the return spring (32) is located right below the tail of the lock switch button (31);

the module A joint bayonets (33-1) are located at two sides of the lock switch button (31), and the module A joint bayonets (33-1) are composed of a toothed opening, a toothed opening spring, a toothed opening carrier rod and a movable knuckle, wherein the toothed opening is located in the toothed opening carrier rod and is a row of triangular movable exposed bayonets; the toothed opening spring is located in the toothed opening and connected with the toothed opening spring and the toothed opening carrier rod through a barrel-shaped hollow column on the front end;

the movable knuckle is located between the lock switch button (31) and the toothed opening carrier rod; one end is connected with the lock switch button (31), and one end is connected with the toothed opening carrier rod;

the toothed opening carrier rod is connected with the lock switch button (31) through the movable knuckle, and the movable knuckle is perpendicular to a position between the toothed opening carrier rod and the lock switch button (31);

the fixed bulge or notch (34) is located on the left end and the right end of the module A and corresponds to a second fixed notch or bulge (37) in the module B;

the first module A ring setting joint (35-1) is connected with one end of the ring setting through an earplug;

the second module A ring setting joint (35-2) and the third module A ring setting joint (35-3) are connected with a front end of the fixed pin (24) and fixedly connected with one end of the ring setting through the fixed cap;

the module B comprises module B joint bayonets (33-2), a first module B ring setting joint (36-1) or a second module B ring setting joint (36-2), a third module B ring setting joint (36-3) and the second fixed notch or bulge (37);

wherein the module B joint bayonets (33-2) are located on two cuboids at the upper inner sides of the module B, a cuboid internally comprises a row of exposed triangular recesses; and the triangular recesses are correspondingly connected with the toothed opening in the module A joint bayonets (33-1);

the second fixed notch or bulge (37) is located on the left end and the right end of the module B and corresponds to the first fixed bulge or notch (34) in the module A;

the first module B ring setting joint (36-1) is located on the lower end of the module B and connected with one end of the ring setting through an earplug, or the second module B ring setting joint (36-2) and the third module B ring setting joint (36-3) are located at two lower sides of the module B and connected with one end of the ring setting through the fixed caps.

4. The kit according to claim 2, wherein a module A comprises a lock switch button (31), a first return magnet (32-1), a second return magnet (32-2), a module A joint bayonet (33-1), a first module A ring setting joint (35-1) or a second module A ring setting joint (35-2) and a third module A ring setting joint (35-3);

wherein the lock switch button (31) used for movably separating the module A and a module B is located on the middle position of the module A;

the first return magnet (32-1) is located inside the lock switch button (31) and plays a role in repelling the second return magnet (32-2) because of like polarities;

the second return magnet (32-2) is located in the middle part of the module A and plays a role in repelling the first return magnet (32-1) because of like polarities;

the module A joint bayonet (33-1) is located at two sides of the lock switch button (31), and the module A joint bayonet (33-1) is composed of a toothed opening, a first toothed opening return magnet (1), a second toothed opening return magnet, a toothed opening carrier rod and a movable knuckle, wherein the toothed opening is located in the toothed opening carrier rod and is a row of triangular movable exposed bayonets, and the toothed opening return magnet is located at a rear end of the toothed opening and returns the toothed opening according to the principle that like polarities repel each other;

the movable knuckle is located between the lock switch button (31) and the toothed opening carrier rod; one end is connected with the lock switch button (31), and one end is connected with the toothed opening carrier rod;

the toothed opening carrier rod is connected with the lock switch button (31) through the movable knuckle, and the movable knuckle is perpendicular to a position between the toothed opening carrier rod and the lock switch button (31);

a fixed bulge or notch (34) is located on the left end and a right end of the module A and corresponds to the fixed notch or bulge (37) in the module B;

the first module A ring setting joint (35-1) is connected with one end of the ring setting through an earplug;

the second module A ring setting joint (35-2) and the third module A ring setting joint (35-3) are connected with a front end of the fixed pin (24) and fixedly connected with one end of the ring setting through the fixed cap;

the module B comprises module B joint bayonets (33-2), a first module B ring setting joint (36-1) or a second module B ring setting joint (36-2), a third module B ring setting joint (36-3) and the second fixed notch or bulge (37);

wherein the module B joint bayonets (33-2) are located on two cuboids at upper inner sides of the module B, the cuboid internally comprises a row of exposed triangular recesses; and the triangular recesses are correspondingly connected with the toothed opening in the module A joint bayonets (33-1);

the second fixed notch or bulge (37) is located on a left end and a right end of the module B and corresponds to the first fixed bulge or notch (34) in the module A;

the first module B ring setting joint (36-1) is located on a lower end of the module B and connected with one end of the ring setting through the earplug, or the second module B ring setting joint (36-2) and the third module B ring setting joint (36-3) are located at two lower sides of the module B and connected with one end of the ring setting through the fixed caps.

5. The kit according to claim 1, wherein each of the fixed caps (25-1) is hollow and similar to a cap structure, and an internal slot corresponding to the bayonet of each of the fixed pins (24-1) is arranged close to a top end; or each of the fixed caps (25-2) has a bulged bayonet corresponding to a slot of each of the fixed pins (24-2) at a tail; or each of the fixed caps (25-3) has the appearance similar to a clip and has a concave annular slot corresponding to the cylindrical bayonet of each of the fixed pins (24-3) at a tail.

6. The kit according to claim 1, wherein the connection component (3) is composed of a module A and a module B to form movable connection.

* * * * *